US011168260B2

(12) United States Patent
Das et al.

(10) Patent No.: US 11,168,260 B2
(45) Date of Patent: Nov. 9, 2021

(54) PROCESS FOR PRODUCTION OF SUPERIOR QUALITY COKE

(71) Applicant: Indian Oil Corporation Limited, Mumbai (IN)

(72) Inventors: Satyen Kumar Das, Haryana (IN); Terapalli Hari Venkata Devi Prasad, Haryana (IN); Ponoly Ramachandran Pradeep, Haryana (IN); Arjun Kumar Kottakuna, Haryana (IN); Madhusudan Sau, Haryana (IN); Debasis Bhattacharyya, Haryana (IN); Sanjiv Kumar Mazumdar, Haryana (IN); Sankara Sri Venkata Ramakumar, Haryana (IN)

(73) Assignee: Indian Oil Corporation Limited, Mumbai (IN)

( * ) Notice: Subject to any disclaimer, the term of this patent is extended or adjusted under 35 U.S.C. 154(b) by 172 days.

(21) Appl. No.: 16/439,791

(22) Filed: Jun. 13, 2019

(65) Prior Publication Data

US 2019/0382662 A1 Dec. 19, 2019

(30) Foreign Application Priority Data

Jun. 14, 2018 (IN) ..... 201821022212

(51) Int. Cl.
*C10B 57/02* (2006.01)

(52) U.S. Cl.
CPC ..... *C10B 57/02* (2013.01)

(58) Field of Classification Search
CPC ..... C10B 57/02
See application file for complete search history.

(56) References Cited

U.S. PATENT DOCUMENTS 4,795,548 A 1/1989 Velasco et al.
6,224,043 B1 * 5/2001 Fan ..... B01D 3/20 261/114.1
6,332,975 B1 * 12/2001 Abdel-Halim ..... C10G 55/04 208/131

* cited by examiner

*Primary Examiner* — Youngsul Jeong
(74) *Attorney, Agent, or Firm* — Blank Rome LLP

(57) ABSTRACT

The present invention relates to a novel process with lower recycle ratio while eliminating the need for quench column for production of superior quality coke conforming to specifications of anode grade coke. The process of the present invention enables production of lower amounts of coke and fuel oil yields.

10 Claims, 2 Drawing Sheets

PROCESS FOR PRODUCTION OF SUPERIOR QUALITY COKE

RELATED APPLICATION

This application claims the benefit of Indian Patent Application No. 201821022212, filed on Jun. 14, 2018. The entire content of that application is hereby incorporated by reference.

FIELD OF THE INVENTION

The present invention relates to production of anode grade coke. More particularly, the present invention relates to system and process scheme for production of anode grade coke. The scheme employs delayed coking process, wherein the heaviest petroleum fractions are subjected to severe thermal cracking to convert into lighter products like fuel gas, LPG, naphtha, kerosene, gas oil, fuel oil, and coke.

BACKGROUND OF THE INVENTION

Delayed coking produces three different types of coke namely Fuel grade. Anode grade, and Needle coke. Of all the three types, needle coke fetches the most premium value, followed by anode grade and fuel grade coke. The type of coke produced from Delayed Coker mainly depends on feed quality and operating conditions, such as temperature pressure and recycle ratio (also known as combined feed ratio i.e., total feed charge amount to furnace over fresh feed charge amount).

U.S. Pat. No. 6,332,975 describes a process where heavy residuum is fed to solvent deasphalting unit to separate into resin containing stream and asphaltene rich oil. The resin containing stream is treated in a delayed coker to produce anode grade coke.

Another U.S. Pat. No. 4,795,548 discloses an integrated process of hydro-treatment and coking. The heavy residuum feed is filtered at 275° F. to remove solids and sent for hydro-desulfurization. The hydrodesulfurized feed is sent to fluidized bed coking process to produce anode grade coke.

In U.S. Pat. No. 6,332,975, solvent deasphalting process was employed to produce anode grade coke. Although, it is a cost effective process, the disposal of asphaltene pitch brings environmental concerns. In another U.S. Pat. No. 4,795,548, fluid coking scheme is employed. Although, coke yield is comparatively less as compared to delayed coking, the process scheme disclosed has a disadvantage in terms of product quality.

It is evident from above prior-arts that the delayed coking process is a widely used residue up-gradation process. However the process has limitations in terms of higher yields of coke as it reduces the refinery margin owing to its low value. The prior-art discloses that the Anode Grade Delayed Coker units are operated at a high recycle ratio, which results in deterioration of yield pattern in terms of higher coke yield and lower distillate yield. Operation at high recycle ratio also results in higher feed input to the furnace, which in-turn increases heat duty as well as fuel requirement. In addition, most of the conventional 'Anode Grade Coker' units are being operated with a 'quench column' to quench the product vapors as well as to remove the heavy boiling material from the product vapors. The heavy boiling component exiting the bottom of the quench column is termed as 'RFO', which is a component of 'fuel oil', a lower value product.

Therefore, operation of 'Anode Grade Coker' in the conventional configuration causes excessive fuel oil generation, which further gets reflected in the low refinery profitability. Further, the prior-arts disclose the process scheme with high hydrogen consumption rates, thereby increasing the operating costs.

Therefore, there is a need of a process, which can be employed in the existing units without the requirement of additional treatment units and further maintaining the product quality and reducing operating costs.

SUMMARY OF THE INVENTION

It is an objective of the present invention to provide a scheme, which can be employed directly in downstream units without any additional treatment units in a delayed coking process for production of anode grade coke.

It is also an objective of the present invention to provide a scheme for production of anode grade coke in a delayed coking process, and further maintaining the product quality and reducing operational costs.

One feature of the present invention is to provide a system for production of anode grade coke using feedstock, such as vacuum residuum, reduced crude oil, clarified oil, etc. The system comprises of:

(a) a fractionator (19) with a shield tray (30) separator between entry location of product vapor stream (31) and preheated feed stream (18) near bottom portion of the fractionator (19), wherein the entry location of the product vapor stream is above the entry location of the preheated feed stream (18), and wherein the shield tray (30) separates the product vapors stream (31) from the preheated feed stream (18);

(b) a furnace (21) to initiate thermal cracking of a mixture (20) of an internal recycle stream and fresh feed to obtain a hot feed stream (22);

(c) coker drums (23) to convert the thermally cracked materials into product vapors stream (24) and anode grade coke;

wherein the system does not necessitate a quench column between the coke drums and the fractionator, and wherein the system operates at a low recycle ratio in the range of 1.01 to 1.2.

Another feature of the present invention is to provide a process scheme to produce anode grade coke using feedstock, such as vacuum residuum, reduced crude oil, clarified oil, etc. The process comprises the steps of:

(a) subjecting preheated feed and product vapors from coke drum to fractionation in a fractionator to obtain distillate products;

wherein entry location of the product vapors is above entry location of the preheated feed near the fractionator bottom, and the entry locations of the preheated feed and the product vapors are separated by a shield tray;

(b) combining a fresh feed with an internal recycle stream and heating to initiate thermal cracking and obtaining hot stream;

(c) subjecting the hot stream obtained in step (b) to delayed coking in coke drum to obtain product vapors and anode grade coke;

wherein the delayed coking is conducted at a low recycle ratio in the range of 1.01 to 1.20; and (d) optionally quenching the product vapors from the coke drums with coker gas oil prior to entry in the fractionator;

wherein the quenched product vapors are separated to final distillate products comprising at least one of fuel gas, naphtha, kerosene, gasoil, and fuel oil.

Another feature of the present invention is to provide a process with lower recycle ratio while eliminating the need for quench column for production of superior quality coke conforming to specifications of anode grade coke.

Another feature of the present invention is to provide a process to produce lower amounts of coke and fuel oil yields.

The present invention provides a process configuration with hardware modifications, such as removal of quench column, modification in fractionator bottom section with shield tray incorporation, etc., which assist in reduction of recycle ratio along with enhanced distillate yield without sacrificing the product quality. The reduction in recycle ratio not only reduces the heat load on fired heater and ensures the good furnace health, but also brings down coke yield which helps to enhance the unit margin. Further, the present invention provides a process, wherein complete feed is converted into products and no additional pitch is generated during the process.

The process of the present invention does not utilize hydrogen and is therefore more cost efficient. Furthermore, the process of the present invention also enables reduction in furnace duty and tube skin temperatures as compared to other conventional anode Coker technologies, therefore making the process more efficient and cost effective.

DETAILED DESCRIPTION OF THE INVENTION

While the invention is susceptible to various modifications and/or alternative processes and/or compositions, specific embodiment thereof has been shown by way of example in tables and will be described in detail below. It should be understood, however that it is not intended to limit the invention to the particular processes and/or compositions disclosed, but on the contrary, the invention is to cover all modifications, equivalents, and alternative falling within the spirit and the scope of the invention as defined by the appended claims.

The tables and protocols have been represented where appropriate by conventional representations, showing only those specific details that are pertinent to understanding the embodiments of the present invention so as not to obscure the disclosure with details that will be readily apparent to those of ordinary skill in the art having benefit of the description herein.

The following description is of exemplary embodiments only and is NOT intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention.

Any particular and all details set forth herein are used in the context of some embodiments and therefore should NOT be necessarily taken as limiting factors to the attached claims. The attached claims and their legal equivalents can be realized in the context of embodiments other than the ones used as illustrative examples in the description below.

The present invention is directed to the production of anode grade coke using "delayed coking process". Further, the present invention is directed to a process scheme, which can be employed directly in downstream units without any additional treatment units and thereby maintain product quality and reduce operating costs.

Figure 1:
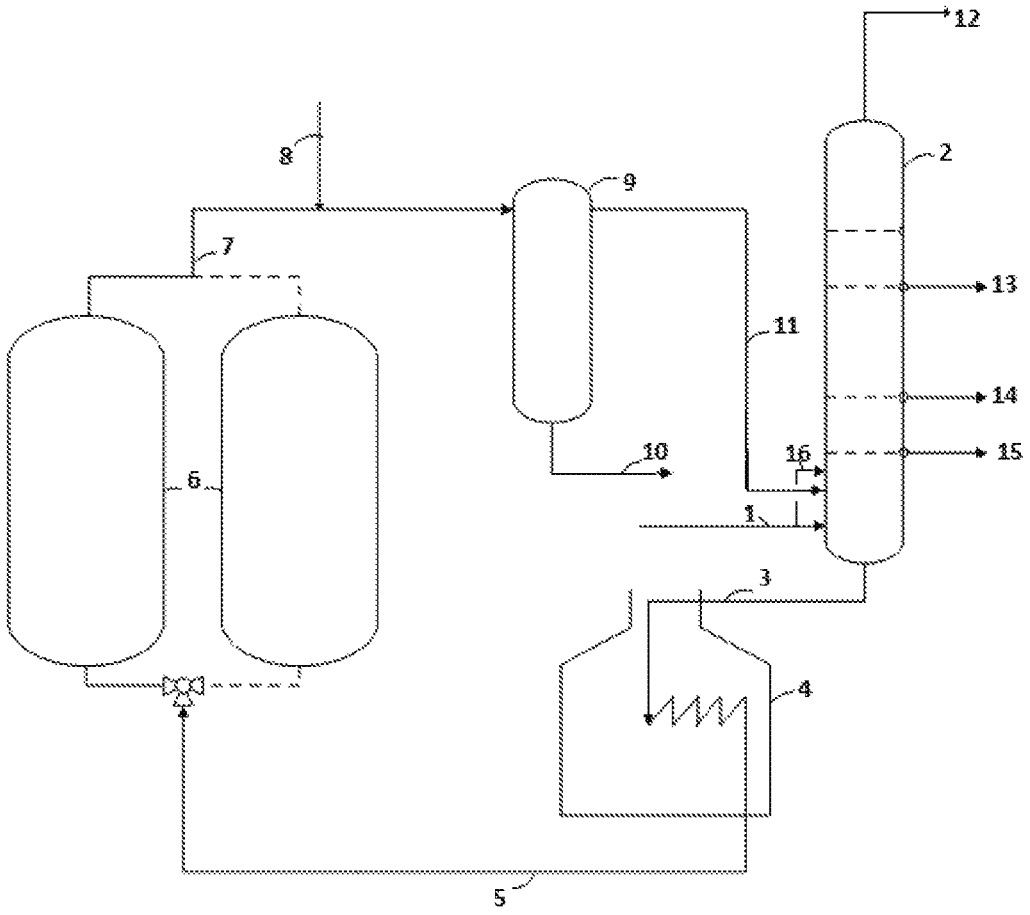
FIG. 1: Schematic representation of conventional delayed coking process to make anode grade coke

In the conventional delayed coking process, as illustrated in FIG. 1, preheated heavy residue feedstock (1) also called as fresh feed is charged to fractionator (2) bottom. The fresh feed is divided into two fractions out of which one fraction enters at an elevation (16) which is above the entry point of the vapor stream (11) from the quench column (9); remaining fraction enters below the vapor entry point. The combined stream (3) containing fresh feed and recycle fraction obtained from partial condensation of coke drum vapor are sent to furnace (4) where it is subjected to severe heat treatment which initiates cracking reactions. The furnace outlet stream (5) is sent to coke drum in operation (6) where most of the cracking reactions take place producing distillate vapors and coke. Once the coke drum reaches safe filling height, then the coke drum feed charge is changed over to new coke drum and the filled drum will undergo coke cutting. Vapors (7) from coke drum are immediately quenched using Coker gas oil (8) and settle in quench column (9) to separate and collect heavy fractions in the bottom termed as residual fuel oil (10) and prevent coke particles carry over to fractionator column. The product vapors/vapour stream (11) from quench column (9) are sent to fractionator (2) for separation into lighters fractions like off gas comprising fuel gas & naphtha (12), light coker gasoil (13), heavy coker gasoil (14), fuel oil (15) etc.

According to a main feature, the present invention provides a system for production of anode grade coke, wherein the system comprises of:

(a) a fractionator (19) with a shield tray (30) separator between entry location of product vapor stream (31) and preheated feed stream (18) near bottom portion of the fractionator (19), wherein the entry location of the product vapor stream is above the entry location of the preheated feed stream (18), and wherein the shield tray (30) separates the product vapors stream (31) from the preheated feed stream (18);

(b) a furnace (21) to initiate thermal cracking of a mixture (20) of an internal recycle stream and fresh feed to obtain a hot feed stream (22);

(c) coker drums (23) to convert the thermally cracked materials into product vapors stream (24) and anode grade coke;

wherein the system does not necessitate a quench column between the coke drums and the fractionator, and wherein the system operates at a low recycle ratio in the range of 1.01 to 1.20.

According to another feature, the present invention provides a delayed coking process for production of anode grade coke, the process comprising the steps of:

(a) subjecting preheated feed and product vapors from coke drum to fractionation in a fractionator to obtain distillate products;

wherein entry location of the product vapors is above entry location of the preheated feed near fractionator bottom, and the entry locations of the preheated feed and the product vapors are separated by a shield tray;

(b) combining a fresh feed with an internal recycle stream and heating to initiate thermal cracking and obtaining hot stream;

(c) subjecting the hot stream obtained in step (b) to delayed coking in coke drum to obtain product vapors and anode grade coke;

wherein the delayed coking is conducted at a low recycle ratio in the range of 1.01 to 1.20; and (d) optionally quenching the product vapors from the coke drums with coker gas oil prior to entry in the fractionator;

wherein the quenched product vapors are separated into final distillate products.

According to an aspect of the present invention, the product vapors from the coke drum are separated from the coke fines using filtration setup installed at the fractionator bottom.

According to another aspect of the present invention, the preheated feed stream is obtained by heating the fresh feed with heat available from the product streams and pump-around of the fractionator.

According to yet another aspect of the present invention, the fresh feed is preheated using the heat available from product streams and pump-around of the fractionator.

Feedstock

According to a preferred feature of the present invention, feedstock is selected from a group consisting of vacuum residuum, reduced crude oil, clarified oil, shale oil, tar, aromatic streams, etc. Vacuum residuum or reduced crude oil may be used either virgin feed or in combination with clarified oil, shale oil, tar, aromatic streams etc. The term "feedstock" here may be defined as the fresh feed or the combined feed comprising the fresh feed and recycle stream.

According to a feature of the present invention, the feedstock employed in the process should have a density of minimum 0.98 g/cc and Conradson Carbon Residue content (CCR) of minimum 2 wt %. Feedstock having Conradson carbon residue more than 30 is not suitable for this process scheme.

According to another feature of the present invention, sulfur content of the feedstock shall be kept within the desired specification of the Anode Grade Coke, which is typically below 3 wt %.

Process Description

According to another embodiment of the present invention, the delayed coking process comprises of preheating the fresh feed using fractionator products, pump-around and charged to the fractionator bottom. The preheated fresh feed and the internal recycle stream are mixed and sent to the furnace where the feed is heated and thereafter sent to the coke drum. In the coke drum, most of cracking reactions take place producing distillate vapors and anode grade petroleum coke.

The vapors from the coke drum directly enter the fractionator bottom without any quench column in between the coke drum overhead and the main fractionator. The distillate vapors are directly sent to fractionator bypassing quench column for separation of lighters distillates, such as off gas, LPG, gasoline, kerosene, gasoil, fuel oil, etc. The shield tray is placed in between the vapor and liquid entries at the fractionator bottom to control the recycle fraction. The coke fines of coke drum vapor are separated using filtration setup installed at the main fractionator bottom.

Process Conditions

According to yet another embodiment of the present invention, the fresh feed is preheated using product and pump around exchangers at a temperature in the range of 280 to 310° C. According to a feature of the present invention, the fractionator operates at a pressure in the range of 1-3 kg/cm$^2$ (g) and top temperature in the range of 80 to 120° C., preferably in the range of 90 to 105° C.

Further, the fractionator bottom operates at a temperature in the range of 300 to 315° C. The process conditions are to be fine-tuned to enable efficient separation.

According to an aspect of the present invention, the furnace outlet temperature is maintained in the range of 485 to 520° C., preferably in the range of 490 to 502° C.

In addition, cold oil velocity inside the furnace tubes is maintained in the range of 1.5 to 3.5 m/sec, preferably in the range of 1.6 to 2.5 m/sec.

According to another embodiment of the present invention, the coke drums in the delayed coking section of the process are operated at a higher severity with desired operating temperature in the range of 470 to 520° C., preferably in the range of 480 to 502° C.

According to another aspect of the present invention, operating pressure of the coke drums are in the range of 0.5 to 5 kg/cm$^2$ (g), preferably in the range of 0.6 to 3 kg/cm$^2$ (g).

According to yet another aspect of the present invention, the recycle ratio is maintained in the range of 1.01 to 1.20, preferably in the range of 1.05 to 1.10.

According to another feature of the present invention, cycle time, or feed filling time in the coke drums is maintained in the range of 10-36 hrs, preferably in the range of 16 to 24 hrs.

Description of Process Flow Scheme

Figure 2:
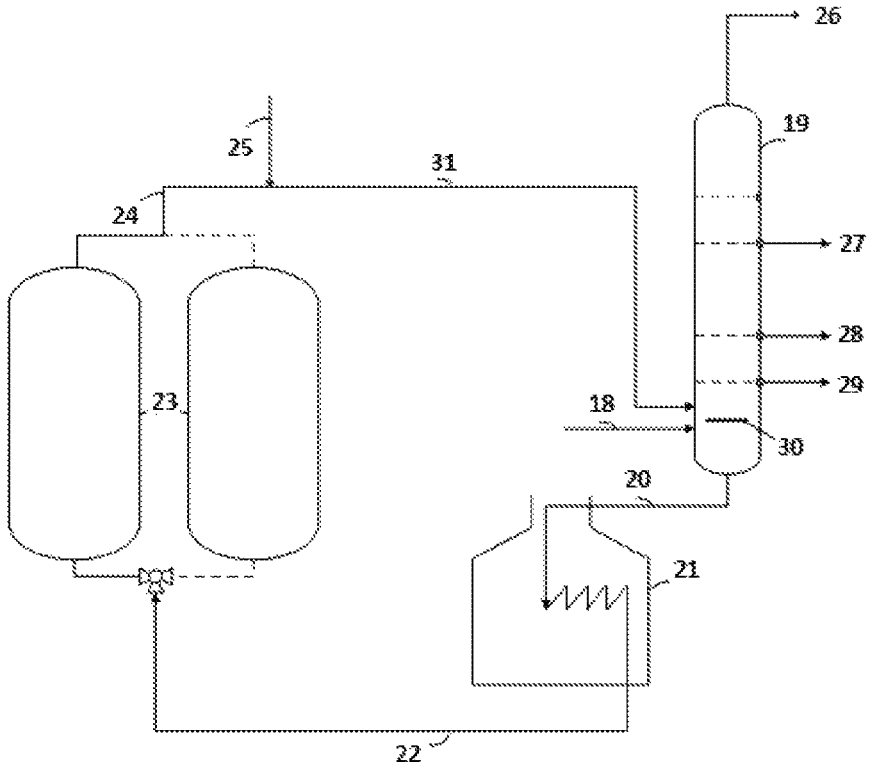
FIG. 2: Schematic representation of process of present invention

According to an embodiment of the present invention, as illustrated in FIG. 2, the fresh feed is preheated using the heat available with product streams and pump-around of fractionator (19). Pre heated heavy residue feed (18) goes to fractionator (19) bottom and quenched product vapors (31) coming from the coke drum enters little above the liquid entry point (18). A shield tray (30) is installed in between the entry locations of fresh feed (18) and the vapor feed (31). Both liquid and vapor streams are separated by heat shield trays to control the radiation from superheated vapor to liquid using which heavy material recycle fraction is reduced. Fresh feed combined with internal recycle fraction stream (20) are sent to furnace (21) to initiate the thermal cracking reactions. Hot stream (22) from furnace goes to coke drums in operation (23) where thermally cracked materials are vaporized leaving coke settled in the drum. The vapors (24) are partially quenched using Coker gas oil (25) to prevent any coke formation and the quenched vapor (31) is routed to the fractionator.

In the current invention, there is no quench column between coke drum and fractionator, which reduces the corresponding heavy material collection and by this, the fuel oil generation is reduced. However, coke fines of coke drum vapor are separated using filtration setup installed at main fractionator bottom. The product vapors are separated into distillate products like off gas comprising fuel gas & naphtha (26), kerosene (27), gasoil (28), fuel oil (29), etc.

Advantages of the Present Invention:

According to a feature, the present invention reduces the coke yield and increases distillate yield during Anode Grade Coke production.

According to another feature, the present invention achieves a low recycle operation of the Coker section, without any deterioration of the liquid product quality from Coker main fractionator.

According to yet another feature, the present invention employs a low recycle ratio, which reduces the heat load of the furnace and fuel consumption.

According to an aspect, the present invention enables significant reduction in emissions of pollutant gases due to low fuel burning.

EXAMPLES

The present invention is exemplified by following non-limiting examples.

Example 1

The process of the present invention was demonstrated in a Pilot plant of 1 barrel/day capacity. Two experiments were carried out in the pilot plant unit.

First experiment (Run-I) was simulating the conventional anode grade production technology, for which the unit was operated at a high recycle ratio of 1.7.

Second experiment (Run II) was conducted simulating the process of current invention at a low recycle ratio of 1.08.

The feedstock employed in the plant is the mixture of vacuum residue and CLO in the ratio of 80:20 (wt %). The properties of the combined feedstock are provided in Table-1.

TABLE 1

Properties of feedstock

| Property | Unit | Combined feed |
|---|---|---|
| Density | g/cc | 1.001 |
| CCR | wt % | 13.9 |
| Sulfur | wt % | 0.91 |
| ASTM D-2887 distillation 5/30/50/90/FBP | ° C. | 326/468/536/648/720 |
| Nickel | ppm | 48 |
| Vanadium | ppm | 22 |

Major operating conditions for the experiments are provided in Table-2.

TABLE 2

Major process conditions

| | Run-I | Run-II |
|---|---|---|
| Coil outlet temperature, ° C. | 500 | 500 |
| Drum Inlet Temperature, ° C. | 486 | 486 |
| Drum pressure, $Kg/cm^2(g)$ | 2.9 | 2.9 |
| Recycle ratio | 1.7 | 1.08 |

The comparative data of process conditions along with product yields for the experiments are provided in Table-3.

TABLE 3

Yield comparison

| | Run-I | Run-II | Δyield |
|---|---|---|---|
| Fuel gas | 7.50 | 7.09 | −0.41 |
| LPG | 4.30 | 5.24 | 0.94 |
| Naphtha (C5-150° C.) | 8.60 | 7.97 | −0.63 |
| Kerosene (150-330° C.) | 24.81 | 26.83 | 2.02 |
| CGO (330-400° C.) | 7.29 | 12.96 | 5.67 |
| CFO + RFO (400° C.+) | 16.50 | 13.45 | −3.05 |
| Coke | 31.00 | 26.46 | −4.54 |

Properties of the coke after calcinations are given in Table-4, which is meeting the Anode Grade Coke specifications.

TABLE 4

Property of Calcined Petroleum Coke (Calcined at 1250° C.)

| | Unit | Value |
|---|---|---|
| Real Density | gm/cc | 2.058 |
| Total Sulfur | wt % | 0.98 |
| Fixed Carbon | wt % | 98.62 |
| VCM | wt % | 0.35 |
| Moisture | wt % | 0.51 |
| Ash | wt % | 0.261 |

The estimated energy savings for a feed capacity of 1 MMTPA in commercial scale due to lower recycle operation similar to that of Run-II is seen to be in the tune of around 35%. In addition, substantial reduction of emissions of $CO_2$, SOx & NOx are expected resulting from lower fuel oil burning in view of the plant operation at low recycle ratio. For a feed capacity of 1 MMTPA, assuming 1 wt % sulfur and 0.64 wt % nitrogen in fuel oil the reduction in emission of $CO_2$, SOx & NOx are estimated at 46528, 296 and 45 MT/year respectively. From the above, it can be seen that the process of current invention converts heavy hydrocarbon residues into higher distillates with lower coke yield meeting 'anode grade' specifications.

Those of ordinary skill in the art will appreciate upon reading this specification, including the examples contained herein, that modifications and alterations to the composition and methodology for making the composition may be made within the scope of the invention and it is intended that the scope of the invention disclosed herein be limited only by the broadest interpretation of the appended claims to which the inventor is legally entitled.

The invention claimed is:

1. A delayed coking process for production of anode grade coke, the process comprising the steps of:

(a) subjecting a preheated feed and product vapors from a coke drum to fractionation in a fractionator to obtain final distillate products;

wherein entry location of the product vapors is above entry location of the preheated feed near the fractionator bottom, and the entry locations of the preheated feed and the product vapors are separated by a shield tray;

(b) routing a mixture of the preheated feed and an internal recycle stream into a furnace and heating the mixture to initiate thermal cracking to obtain a hot stream, wherein the internal recycle stream is a remainder stream obtained in the fractionator after separation of the final distillate products;

(c) subjecting the hot stream obtained in step (b) to delayed coking in the coke drum to obtain the product vapors and anode grade coke;

wherein the delayed coking is conducted at a recycle ratio in a range of 1.01 to 1.20, wherein the recycle ratio refers to total feed charge amount to the furnace over a fresh feed charge amount; and (d) quenching the product vapors from the coke drum with a coker gas oil prior to entry in the fractionator to obtain quenched product vapors;

wherein the quenched product vapors from step (d) are fractionated in the fractionator to obtain the final distillate products, and wherein the final distillate products comprise of at least one of fuel gas, naphtha, kerosene, gasoil, and fuel oil;

wherein the preheated feed is obtained by heating the fresh feed with heat available from the final distillate products obtained in the fractionator and pump-around of the fractionator.

2. The process as claimed in claim 1, wherein the fresh feed comprises of at least one of vacuum residuum, reduced etude oil, and clarified oil.

3. The process as claimed in claim 2, wherein the vacuum residuum and/or reduced crude oil is used as at least one of the fresh feed and/or in combination with at least one of clarified oil, shale oil, tar, and aromatic streams.

4. The process as claimed in claim 1, wherein the fresh feed has a density of minimum 0.98 g/cc, Conradson Carbon Residue content (CCR) in a range of 2-30 wt %, and sulfur content below 3 wt %.

5. The process as claimed in claim 1, wherein the fresh feed is heavy residue feed.

6. The process as claimed in claim 1, wherein the fresh feed is preheated at a temperature in a range of 280 to 310° C.

7. The process as claimed in claim 1, wherein the fractionator operates at a pressure in a range of 1 to 3 $kg/cm^2$ (g) and a temperature in a range of 80 to 120° C.

8. The process as claimed in claim 1, wherein the fractionator bottom operates at a temperature in a range of 300 to 315° C.

9. The process as claimed in claim 1, wherein the coke drum in step (c) operates at a temperature in a range of 470 to 520° C. and a pressure in a range of 0.5 to 5 $kg/cm^2$ (g).

10. The process as claimed in claim 1, wherein the furnace operates at an outlet temperature in a range of 485 to 520° C.

* * * * *